US006477791B2

(12) United States Patent
Luthi et al.

(10) Patent No.: US 6,477,791 B2
(45) **Date of Patent: *Nov. 12, 2002**

(54) SHOE WITH STABILITY ELEMENT

(75) Inventors: Simon Luthi, Lake Oswego, OR (US); Frans Xavier Karl Kalin, Diespeck-Dettendorf (DE); Jeffrey E. Gebhard, Portland, OR (US); Charles D. Kraeuter, Lake Oswego, OR (US)

(73) Assignee: adidas International B.V. (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/769,541

(22) Filed: Jan. 25, 2001

(65) Prior Publication Data

US 2001/0001907 A1 May 31, 2001

Related U.S. Application Data

(63) Continuation of application No. 09/286,737, filed on Apr. 6, 1999.

(30) Foreign Application Priority Data

Feb. 5, 1999 (DE) ..... 199 04 744

(51) Int. Cl.[7] ..... A43B 7/24; A43B 23/00

(52) U.S. Cl. ..... 36/31; 36/30 R; 36/142; 36/107

(58) Field of Search ..... 36/30 R, 31, 88, 36/107, 142, 143, 144

(56) References Cited

U.S. PATENT DOCUMENTS

| | | | | |
|---|---|---|---|---|
| 3,550,597 | A | 12/1970 | Coplans | 36/144 |
| 4,364,189 | A | 12/1982 | Bates | 36/31 |
| 4,766,679 | A | 8/1988 | Bender | 36/30 R |
| 4,798,010 | A | 1/1989 | Sugiyama | 36/31 |
| 5,052,130 | A | 10/1991 | Barry et al. | 36/30 R |
| 5,179,791 | A | 1/1993 | Lain | 36/144 |
| 5,297,349 | A | 3/1994 | Kilgore | 36/31 |
| 5,572,805 | A | 11/1996 | Giese et al. | 36/30 R |
| 5,647,145 | A | 7/1997 | Russell et al. | 36/28 |
| 5,720,118 | A | 2/1998 | Mayer et al. | 36/30 R |
| 5,832,634 | A | 11/1998 | Wong | 36/31 |
| 6,199,303 | B1 * | 3/2001 | Luthi et al. | 36/31 |

* cited by examiner

*Primary Examiner*—M. D. Patterson
(74) *Attorney, Agent, or Firm*—Testa, Hurwitz & Thibeault, LLP

(57) ABSTRACT

An article of footwear including a sole with a stability element constructed of a material and configured for controlling, in a preselected manner, the rotation of the forefoot portion of the article of footwear around the longitudinal axis with respect to the rearfoot portion.

14 Claims, 13 Drawing Sheets

A: SHOE WITHOUT STABILITY ELEMENT;

B: SHOE WITH A STABILITY ELEMENT HAVING A LONGITUDINAL BENDING STRENGTH OF 450 $N/mm^2$ AND A LATERAL BENDING STRENGTH OF 93 $N/mm^2$.

C: SHOE WITH A STABILITY ELEMENT HAVING A LONGITUDINAL BENDING STRENGTH OF 495 $N/mm^2$ AND A LATERAL BENDING STRENGTH OF 151 $N/mm^2$.

SHOE WITH STABILITY ELEMENT

CROSS-REFERENCE TO RELATED APPLICATION

This application incorporates by reference, and claims priority to, and the benefit of, German patent application serial number 19904744.8, which was filed on Feb. 5, 1999 and U.S. patent application Ser. No. 09/286,737, filed Apr. 6, 1999, of which this is a continuation.

TECHNICAL FIELD

The invention relates to an article of footwear with a sole that includes a stability element to control, in a preselected manner, the rotation of the forefoot area with respect to the rearfoot area of the article of footwear.

BACKGROUND INFORMATION

The processes in the human foot during walking or running are enormously complex. Between the first contact of the heel and the push-off with the toes, a number of different movements take place throughout the entire foot. During these movements, various parts of the foot move or turn with respect to each other.

It is an objective in the construction of "normal" footwear, to obstruct these natural movements, such as they occur in barefoot running, as little as possible and to support the foot only where it is necessary for the intended use of the footwear. In other words, the objective is to simulate walking or running barefoot.

In contrast thereto, it is an objective of orthopedic footwear to correct malpositions or orthopedic deformities of the foot, for example, by reinforcing the material in certain parts of the sole to provide additional support for the foot. The present invention, however, focuses on the construction of footwear for "normal" feet, though it may be useful in other applications.

In this context, it was already realized in the past that the classical outsole, which extends over the entire article of footwear, does not meet the above mentioned requirements. In particular, rotations of the forefoot area around the longitudinal axis of the foot with respect to the rearfoot area (referred to in physics as torsional movements) are, at the least, considerably hindered by a homogeneously formed, continuous outsole or arrangement of soles.

To overcome these difficulties, stability elements were developed which supply separate parts of the sole with a controlled rotational flexibility, and which define by their form and their material the resistance of the sole against such twisting movements.

One example of a known stability element is disclosed in U.S. Pat. No. 5,647,145. The footwear sole construction described in this prior art approach complements and augments the natural flexing actions of the muscles of the heel, metatarsals and toes of the foot. To meet this objective, the sole comprises a base of resiliently compressible material, a plurality of forward support pads supporting the toes, a plurality of rearward support lands supporting the metatarsals, a heel member supporting and protecting the heel of the wearer's foot, and a central heel fork which overlays and is applied to the heel member. At heel strike, the heel fork tends to help stabilize and hold or reduce the rearfoot from over-supination or over-pronation by guiding and stabilizing the heel bone.

Another embodiment of a known stability element (which is similar to the above described heel fork) is shown and discussed in conjunction with FIG. 14 of the present application. The stability element 10' shown in FIG. 14 is shaped like a bar, a cross, or a V, and starts at the rearfoot area 2' of the sole and terminates in the midfoot area of the sole.

These known stability elements are capable of providing some stability to the various parts of the foot through their rigidity, however, an important disadvantage is that they provide insufficient joint support for the longitudinal and lateral arch of the foot. Compared to an ordinary continuous sole molded to the contour of the foot, stability is considerably reduced.

Furthermore, the arrangement of layers of foamed materials typically used in the forefoot area is relatively yielding so that due to the high impact forces that occur during running the sole yields on the medial or lateral side, and the foot rotates in response thereto by a few degrees to the inside or the outside, particularly if the wearer's foot anatomy tends to support such rotational movements. These rotational movements are known in the art as pronation and supination, respectively, and lead to premature fatigue of the joints of the foot and knee, and sometimes to injuries.

Additionally, a sole with a soft or yielding forefoot area leads to a loss of energy. The deformation of the sole during the push-off phase of the step is not elastic, therefore, the energy used for the preceding deformation of the sole cannot be regained.

It is an objective of the present invention to provide an article of footwear which controls, in a preselected manner, the rotation of the forefoot area with respect to the rearfoot area and at the same time supports the forefoot area to avoid excessive pronation or supination, thereby reducing and/or preventing premature fatigue or injuries to the wearer.

According to another aspect of the invention, the footwear sole should store any energy applied during the landing phase and supply it to the course of movements at the correct time during the push-off phase of the foot.

SUMMARY OF THE INVENTION

In one aspect, the invention relates to an article of footwear including a rearfoot portion, a forefoot portion, and a sole with a stability element. The stability element extends from the rearfoot portion into the forefoot portion, and is constructed of a material and configured for controlling, in a preselected manner, the rotation of the forefoot portion of the shoe around the longitudinal axis with respect to the rearfoot portion.

The stability element can extend substantially along the medial side of the shoe, or substantially along the lateral side. The stability element can include a forefoot area including material properties for reducing pronation or supination of the wearer's foot.

According to another embodiment, in this case for pronation control, metatarsals one and/or two of the wearer's foot are supported, preferably together with phalanges one and/or two. In the case of supination control, metatarsals five and preferably four are supported, preferably together with phalanges five and/or four.

Due to the extension of the stability element from the rearfoot portion into the forefoot portion where the metatarsals and phalanges are located, the foot is supported over its effective longitudinal length without affecting the flexibility of the footwear with respect to the twisting of the forefoot portion relative to the rearfoot portion. Excessive strain or the breaking of the longitudinal arch of the foot under high stress, for example, the landing after a leap, is effectively avoided. In addition, the stability element supports the front part of the foot in the forefoot area.

A camera using high-speed film photographed the feet of running athletes during a pronation study. The photographs show that footwear with a supported forefoot area effectively avoids the turning of the foot to the medialside. The reason is that the material properties of the stability element in the forefoot area of an article of footwear do not yield on the medial side under higher pressure. Preferred materials for the forefoot area of the stability element have a longitudinal bending strength in the range of approximately 350 $N/mm^2$ to 600 $N/mm^2$ and a lateral bending strength of approximately 50 $N/mm^2$ to $200/mm^2$ (measured according to DIN 53452).

According to another embodiment of the invention, the stability element comprises an elastic forefoot plate, or has elastic properties in the forefoot area. During landing of the foot and the subsequent rolling of the toes, the forefoot area is elastically bent. In the subsequent course of the movement, after the rearfoot part has left the ground, the foot is stretched to push-off from the ground. At this moment, the forefoot area of the stability element springs elastically back into its original shape; thereby supporting the push-off from the ground. In this way, the energy invested for the elastic deformation of the shoe is regained and aids the continuation of the movement. The forefoot plate or area preferably shows a stiffness in the range of approximately 50 N/mm to 100 N/mm (measured according ASTM 790).

According to another embodiment, the stability element includes two parts connected in a V-like shape. This allows precise adaptation to the different forms of both the medial and the lateral side of the longitudinal arch of the foot.

The stability element can include at least one support element at its side. The lateral arch of the foot is specifically supported by the support element(s) of the stability element. The stability element can also include at least one side element which extends upwardly from the side of the stability element over the edge of the footwear. This embodiment is preferred for use in sports with a high lateral strain on the foot.

The above mentioned material properties can be obtained by manufacturing the stability element from a composite material of resin and carbon fibers.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different views. Also, the drawings are not necessarily to scale; emphasis instead generally being placed upon illustrating the principles of the invention. In the following description, various embodiments of the present invention are described with reference to the drawings which show.

Figure 7:
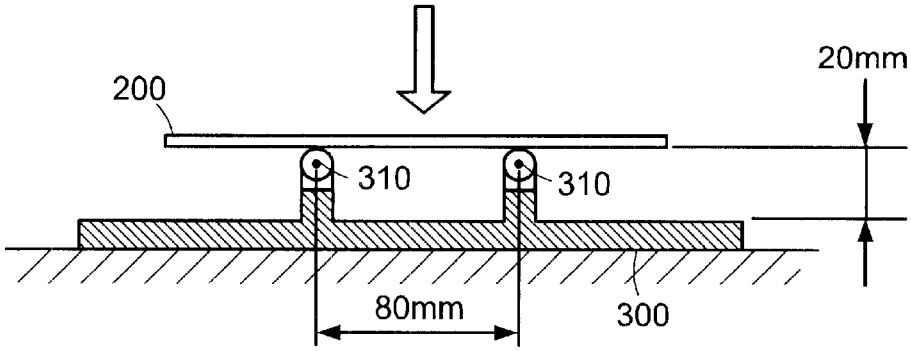
Figure 8:
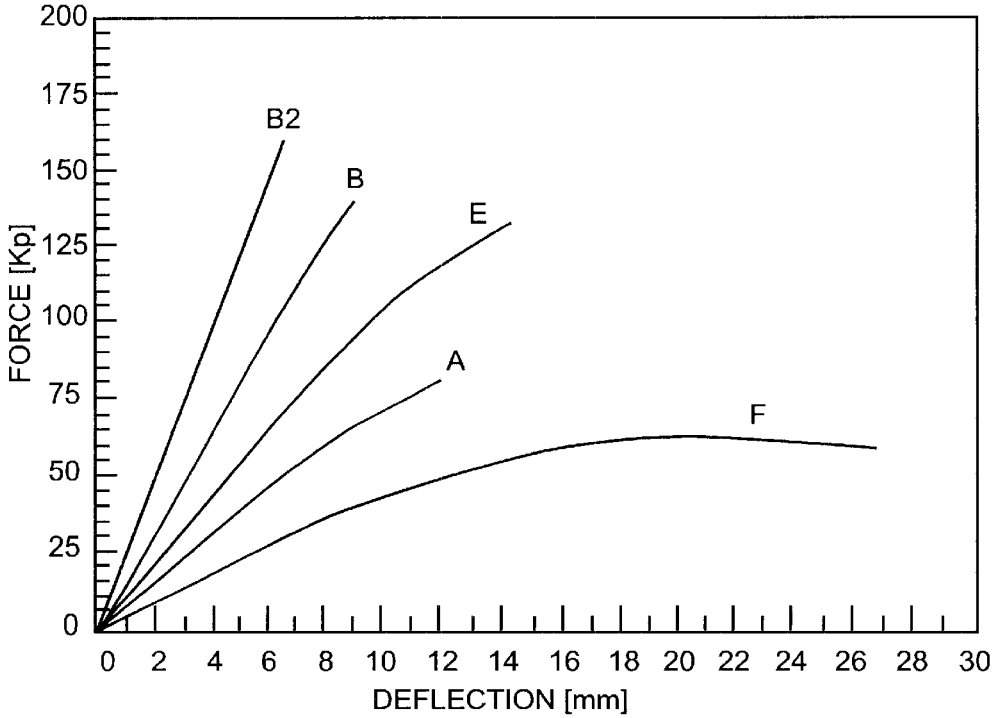
Figure 9:
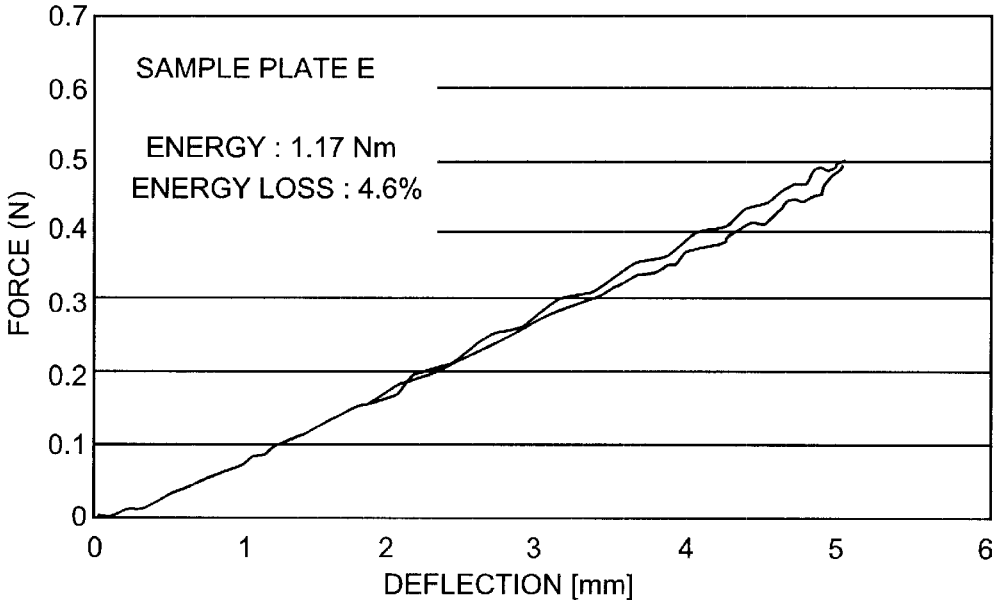
Figure 10:
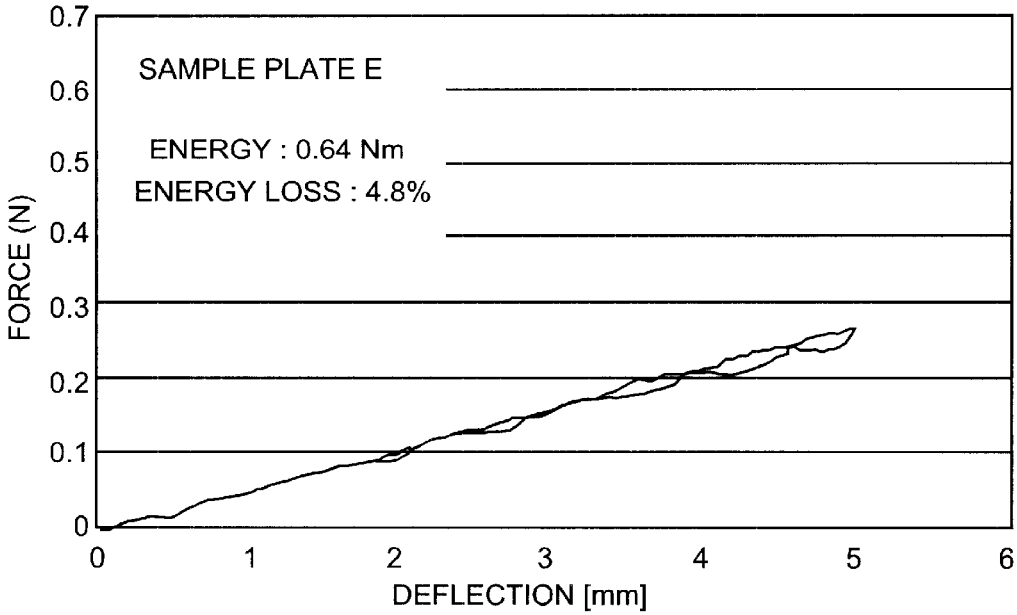
Figure 11:
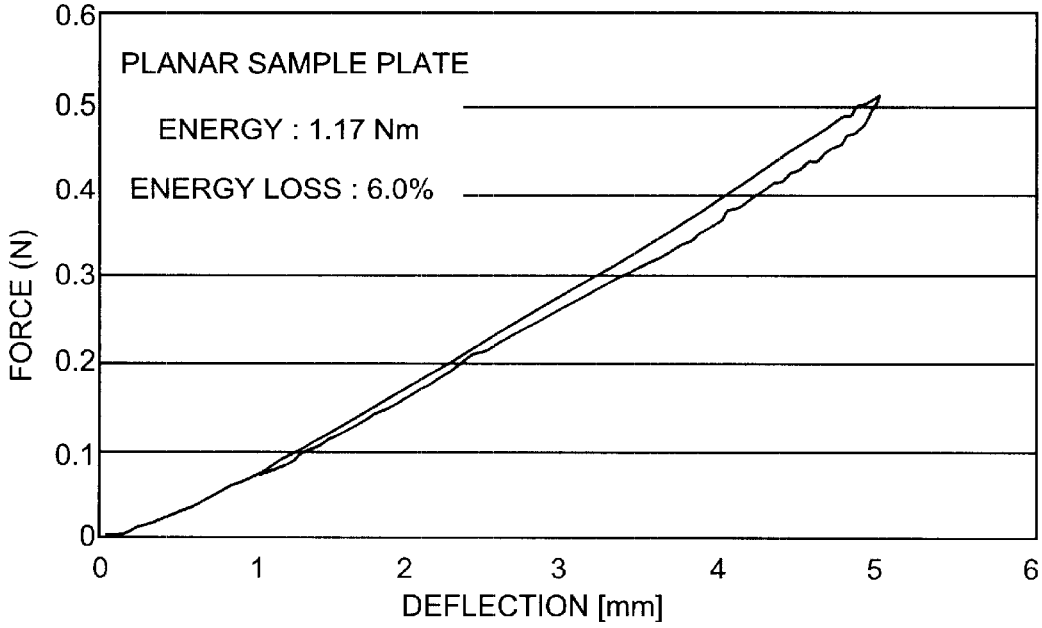
Figure 12:
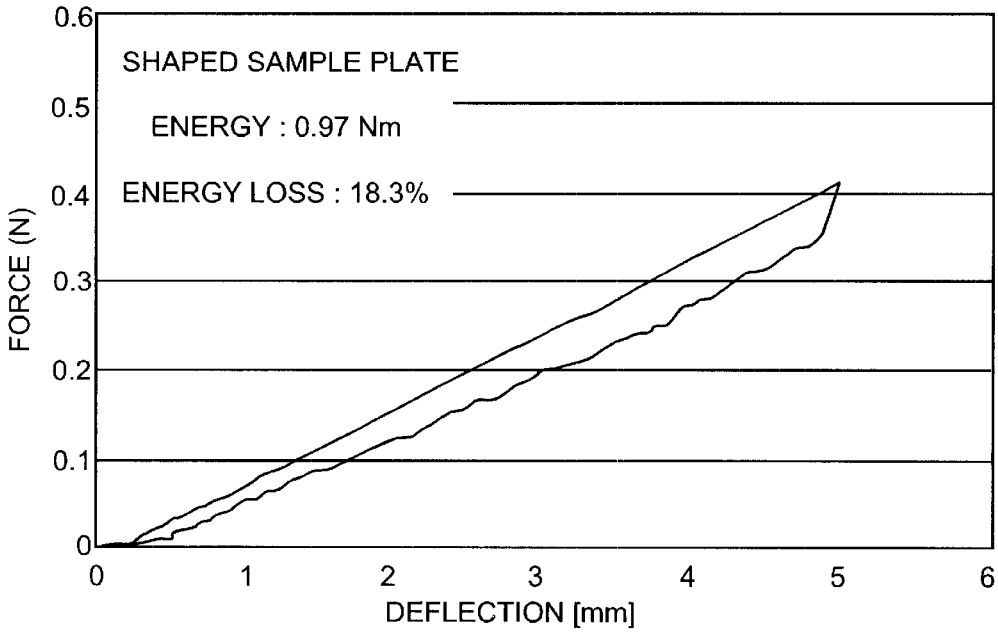
Figure 13A:
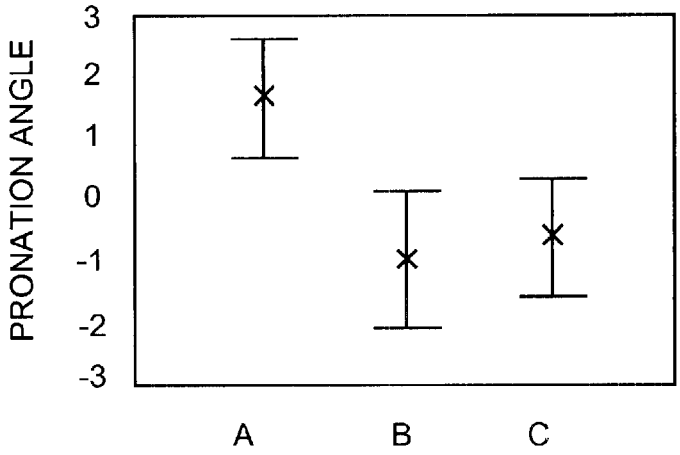
Figure 13B:
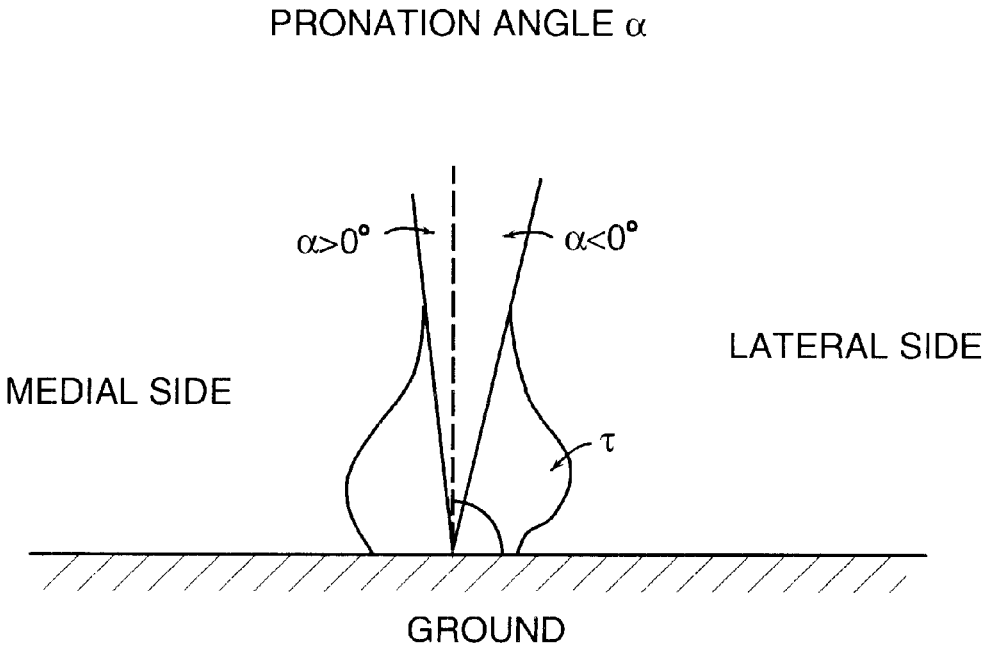

FIG: 6: Another embodiment of the invention wherein the medial and the lateral part of the stability element extend into the forefoot area;

FIG. 7: A test installation to determine the stiffness of the forefoot plate;

FIG. 8: Force-deformation characteristics to determine the stiffness of the forefoot plate;

FIG. 9: Hysteresis loop of the deformation of the sample plate E;

FIG. 10: Hysteresis loop of the deformation of the sample plate F;

FIG. 11: Hysteresis loop of the deformation of a planar sample plate;

FIG. 12: Hysteresis loop of a shaped sample plate;

FIG. 13*a*: Results of the pronation measurements with different stability elements;

FIG. 13*b*: A schematic drawing for explaining the pronation angle; and

Figure 14:
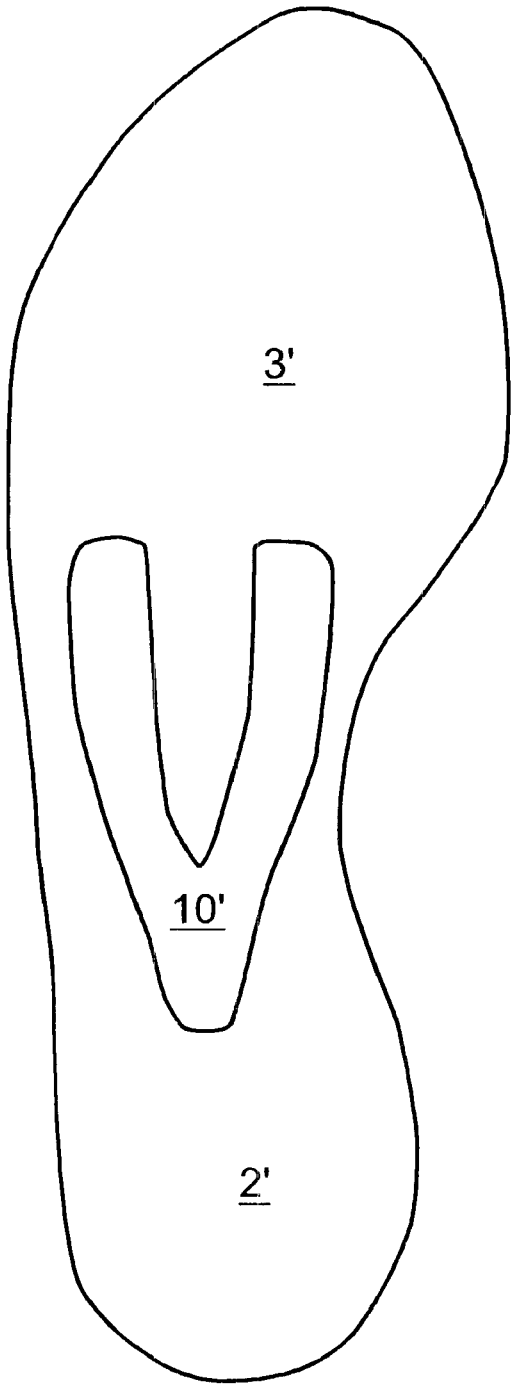

FIG. 14: A prior art shoe incorporating a V-shaped stability element.

DESCRIPTION

According to one embodiment of the present invention, an article of footwear comprises a stability element, which is arranged beneath the foot of the wearer. This can be achieved by integrating the stability element in accordance with the present invention into the outsole of the to article of footwear, or sandwiching it between the outsole and the midsole, or between the midsole and the insole. If the stability element is arranged within the outsole, it may differ in color from the surrounding material of the sole, so that the special form (which is an indication for which sport the corresponding article is intended, as described more fully below) of the stability element can easily be recognized from the outside. According to another embodiment, the outsole itself consists essentially of the stability element. In this case, an optional midsole and an optional insole can be applied to the upper side of the stability element to provide comfort and damping to the wearer of the article.

The above described different possible arrangements of the stability element do not significantly influence the functional properties of the article comprising the stability element in accordance with the present invention, therefore, reference is made in the following (and in the Figures) only to an article of footwear in general.

Figure 1:
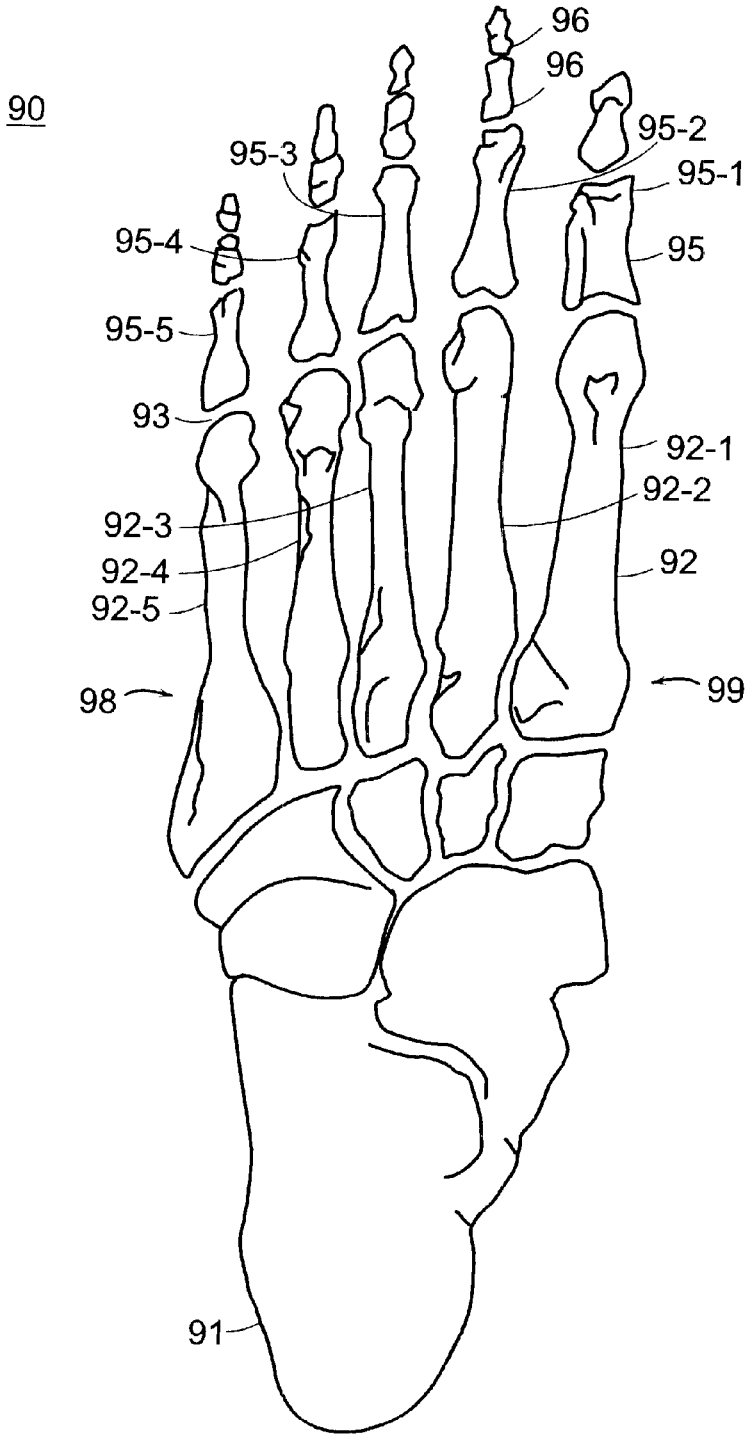
FIG. 1: A skeleton of a human foot for explaining certain principles of the present invention.

Before the design and the functional characteristics of the stability element in accordance with the present invention are described in detail, reference is made to the skeleton of a human foot 90 shown in FIG. 1, to facilitate the understanding of the inventive principles with respect to the particular parts of the foot that are selectively supported.

In FIG. 1, reference numeral 92 depicts the metatarsals of a left human foot 90, and reference numeral 95 depicts the phalanges (toes). Essentially, both the metatarsals 92 and the phalanges 95 form the forefoot part of the foot. The metatarsal-phalangeal joints 93 are located between metatarsals 92 and phalanges 95. The phalanges 95 include a plurality of interphalangeal joints 96. During a walking or running cycle, the metatarsal-phalangeal joints 93 and the interphalangeal joints 96 allow the foot to flex and push-off from the ground.

Altogether, there are five metatarsals 92 referred to as the first, second, third, fourth and fifth metatarsal's, 92-1 to 92-5, moving from the medial side 99 of the foot to the lateral side 98. Similarly, there are five phalanges, 95-1 to 95-5. Finally, the heel bone 91 is depicted.

For a stability element in accordance with the present invention, it is important for the sake of pronation or supination control to appropriately support the phalanges and the metatarsals. In the case of pronation control, metatarsal 92-1 and/or metatarsal 92-2 is supported, preferably with phalange 95-1 and/or 95-2. In the case of supination control, metatarsal 92-5 and/or metatarsal 92-4 is supported, preferably with phalange 95-5 and/or 95-4. The necessary support is provided by a stability element in accordance with the present invention, however, since supination is rarely a problem, and for the sake of conciseness in the following description, only pronation control stability elements are discussed. The present invention is, however, not restricted to this field. Complementary shaped stability elements supporting the respective metatarsals and phalanges for supination control are also covered by the present inventive concept.

Figure 2:
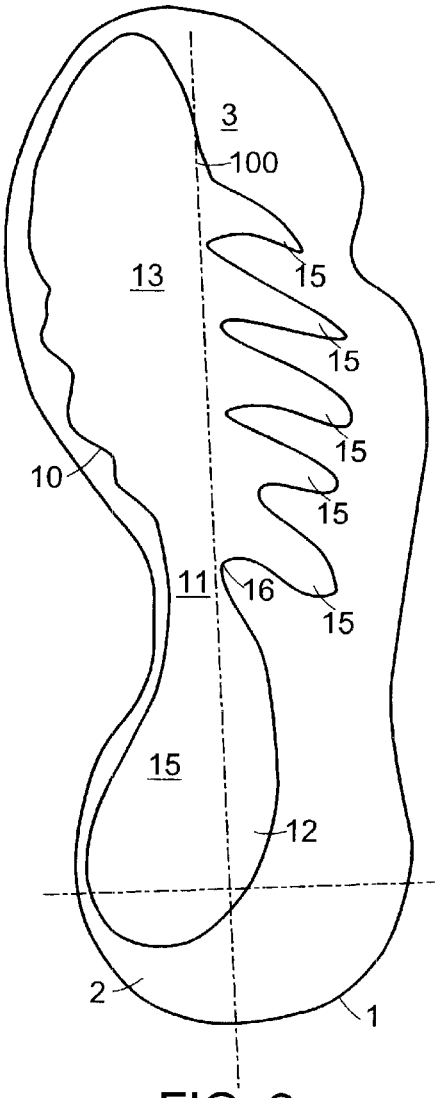
FIG. 2: An article of footwear according to one embodiment of the invention.

One embodiment of a stability element for an article of footwear 1 for a right foot, in accordance with the present invention, is shown in FIG. 2. The stability element 10 comprises an oblong shape with a rearfoot area 12 and a forefoot area 13. The stability element 10 extends from the rearfoot portion 2 of the article of footwear 1 into the forefoot portion 3. As may be derived from FIG. 2, the forefoot area 13 is designed and located within the shoe such that the first and/or second metatarsal of the wearer's foot rests on the stability element, with any necessary additional sole layers therebetween, and are effectively supported. According to a particular embodiment of the invention, the stability element also supports the first and/or second phalange.

Between areas 12 and 13, the stability element 10 comprises an area 11 with reduced lateral dimensions which allows twisting of the forefoot area 13 of the stability element 10 (and thereby of the footwear) relative to the rearfoot area 12. The resistance and twisting of the stability element 10 in the area 11 defines the rotational flexibility of the footwear. A defined rotational flexibility can also be achieved by a more elastic material in area 11.

The above described stability element has several important advantages over the prior art. First, since the stability element 10 extends almost over the complete longitudinal extension of the article of footwear 1, the longitudinal arch of the foot is effectively supported over its total length. Many injuries which may occur if the arch is overstressed are avoided.

Second, support at the forefoot area of an article of footwear, which is the part subjected to the greatest load during running or walking, is significantly improved. In the embodiments of the invention shown in FIGS. 2 to 4, the forefoot area 13 of the stability element 10 extends substantially along the medial side of the article of footwear to compensate for excessive pronation, as discussed above.

And last, any twisting movement of the forefoot portion 3 of an article of footwear 1 with respect to the rearfoot portion 2 can be controlled in a preselected manner by the shape and the selection of the material of the stability element 10 in area 11.

To determine the material properties of the stability element in the forefoot area 13 which are well suited to reduce pronation, the foot contacts of running athletes were filmed from behind with a high speed camera taking 200 images per second. These recordings were analyzed to determine the maximum pronation angle of the foot with respect to the material properties of the stability element in the forefoot area. The pronation angle or rearfoot angle is defined as the angle $\alpha$ between a vertical line through the foot and the plane of the ground (see FIG. 13*b*). In a normal position of the foot, this angle is 90°. All measured angles were therefore referenced to this value so that a positive value corresponds to a rearfoot angle of more than 90°, i.e., pronation, and a negative angle corresponds to a rearfoot angle of less than 90°, i.e., supination.

As a result of this study (see FIG. 13*a*), it was found that a stability element 10 with a bending strength in the longitudinal direction, i.e., parallel to the fiber direction (the fibers being aligned with a:longitudinal axis of the shoe), between 350 $N/mm^2$ and 600 $N/mm^2$ (measured according to DIN 53452), and a bending strength in the lateral direction, i.e., perpendicular to the fiber direction, between 50 $N/mm^2$ and 200 N/mm successfully reduced the maximum pronation angle of the foot. In particular, bending strengths between approximately 450 $N/mm^2$ and 500 $N/mm^2$ and between approximately 90 $N/mm^2$ and 160 $N/mm^2$ yielded the best results. Whereas athletes wearing footwear without a stability element (see sample a in FIG. 13*a*) showed a pronation angle of 1.6 degrees, the pronation was considerably reduced (−0.9 and −0.6 degrees, see samples b and c in FIG. 13*a*, the error bars indicate statistical errors of the measurements) with athletes wearing footwear equipped with stability elements having the above described material properties.

According to a second aspect of the present invention, the stability element 10 preferably comprises in the forefoot area 13 an elastic forefoot plate which stores energy by elastic deformation during the landing of the foot and releases the energy essentially without any loss during the push-off of the foot from the ground to facilitate and support the course of motion. Although, it would in principle be possible to integrate this forefoot plate into the shoe independent of, a stability element, for cost and production it may be advantageous and preferred to combine these two parts. In the described embodiments, the forefoot plate can therefore be invisibly integrated into the forefoot area 13 of the stability element 10 (and therefore not shown in the Figures). According to an alternative embodiment the stability element 10 itself consists of an elastic material to achieve the described energy storing function.

In the following, the forefoot plate or the stability element is further described with respect to its elasticity, which is the necessary precondition for the substantially loss-free storing and release of the energy from the deformation of the plate.

For noticeable support of an athlete during running, in particular during sprints, the forefoot plate should have a stiffness which is both great enough to facilitate the push-off of the foot with the energy that has been stored during the landing, and not so stiff as to undesirably hinder the natural course of motion. Studies with athletes have shown that a stiffness in the range of approximately 50 N/mm to 100 N/mm is best suited to meet these requirements. The stiffness was measured with an ASTM 790 test installation as shown in FIG. 7 and described in the following.

To this end, a 250 mm long and 50 mm wide sample plate 200 of the material to be tested is symmetrically positioned on two 80 mm distant support points 310. Subsequently, the sample plate is deformed with the vertical force which acts upon the sample plate in the center (vertical arrow in FIG.

7). In this way, the deformation of the sample plate depending on the force can be measured with a dynamometer. FIG. 8 shows results of measurements of sample plates with varying stiffnesses. The stiffness is the gradient of the curve in the linear range, i.e., the range of small deformations. For application as a forefoot plate, a stiffness between approximately 50 N/mm (sample plate F) and approximately 100 N/mm (sample plate E) is preferred.

Another important criteria for a forefoot plate is elasticity, i.e., whether the force necessary for the deformation can be regained when the plate springs-back into its original shape. FIGS. 9 to 12 show hysteresis loops of different sample plates, each with a stiffness between approximately 50 N/mm and 100 N/mm. To measure these loops, the force was measured by cyclically deforming and releasing the sample plates in the above described test installation (FIG. 7), where the time for one cycle was 200 milliseconds. The difference between the upper and lower line, i.e., the area enclosed by the two lines, is representative of the loss of elastic energy during the deformation of the sample plates.

It follows from the curves in FIGS. 9 to 11 that the energy loss in the planar shaped sample plates of the above mentioned stiffness is between 4.6% and 6%, i.e., a major part of the energy is regained during the spring-back into the original shape. FIG. 12 shows a hysteresis loop for a sample plate that was not planar shaped. The significantly greater energy loss of this plate, 18.3%, is shown in FIG. 12. The forefoot plate according to the invention is, therefore, preferably planar.

Figure 3:
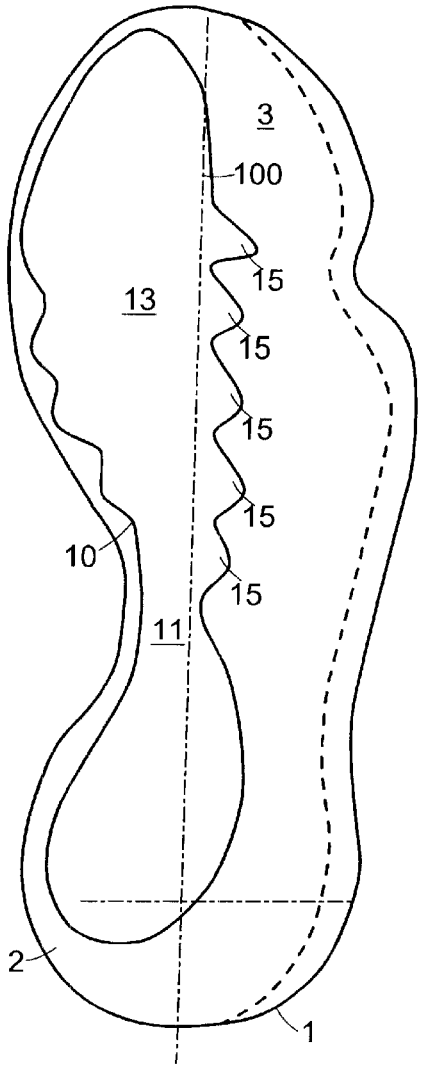
FIG. 3: Another embodiment of the invention, in particular an article of footwear with a narrower sole.

With respect to the shape of the stability element 10, additional support elements 15 can be arranged at the side in the forefoot area 13 as well as at the rearfoot area 12, which extend essentially laterally with respect to the longitudinal axis of the foot, as shown in FIGS. 2 and 3. The support elements 15 extend the supporting effect of the stability element 10 into the lateral and medial side parts of the article of footwear 1 to enhance protection of the lateral arch of the foot against excessive strain. The extension of the side elements 15 depends on the shape of the article of footwear. FIG. 3 shows an embodiment for a narrower article of footwear, where the supporting elements 15 are correspondingly shorter.

Figure 4:
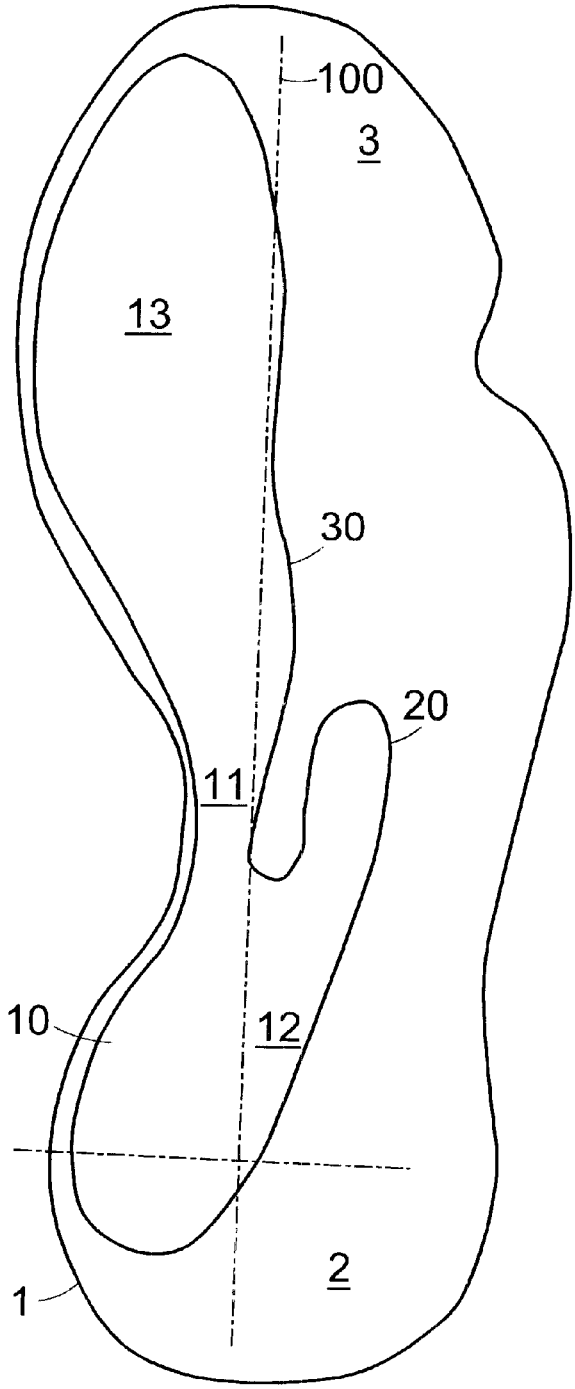
FIG. 4: Another article of footwear constructed in accordance with the teaching of the invention and incorporating a stability element including two parts connected in a V-like shape.

In a further embodiment of a stability element, as shown in FIG. 4, the stability element 10 comprises two parts, 20 and 30, which form a V-like shape. Part 30 supports the medial part and part 20 the lateral part of the longitudinal arch of the foot. The connection of the two parts, 20 and 30, in rearfoot area 12 of stability element 10 allows, (in contrast to a "normal" continuous sole) for twisting around area 11, and relative movement of the two parts, 20 and 30, with respect to each other.

Figure 5A:
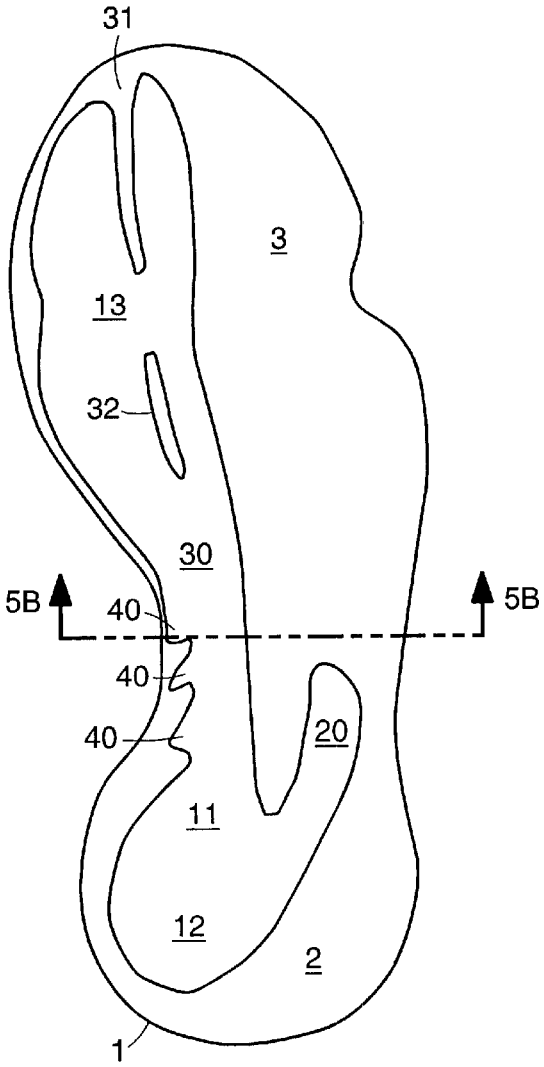
FIG. 5A Another embodiment of the invention with three additional side elements.

In the embodiments of stability elements shown in FIGS. 5A land 6, the medial part 30 of the stability element 10 comprises notches 31 and holes 32 to increase the flexibility of the stability element in the forefoot portion 3 in the lateral direction. The embodiment shown in FIG. 5A is optimized for sports where the foot is not subjected to extreme lateral stress; for example, track-and-field athletics, jogging, etc. Support of the lateral half of the foot is, therefore, only necessary in the midfoot area so part 20 is designed correspondingly shorter then part 30. In the embodiment shown in FIG. 6, the lateral part 20, as well as the medial part 30, extends into the forefoot portion 3 of the article of footwear. This embodiment, in particular, is used in sports with many changes of direction and many sideways steps; for example, tennis, basketball, etc. The elongated part 20 in this case serves to support the lateral side of the forefoot against the high strain resulting from these movements.

Figure 6:
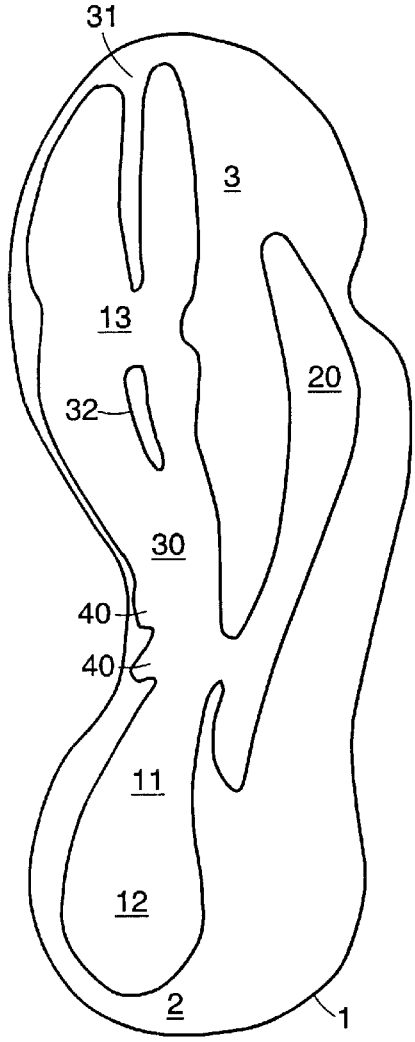
Figure 5B:
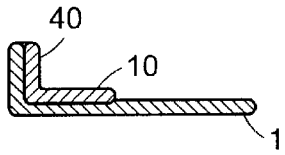
FIG. 5B: A cross-sectional view including a side element of the embodiment shown in FIG. 5A.

In the embodiment shown in FIGS. 5A–B and FIG. 6, additional side elements 40 are provided to increase the stability of the connection between the stability element 10 and the surrounding material of the article of footwear in the area 11 by sideways and upwardly encompassing the article of footwear. In the embodiments shown, side elements 40 are provided on the medial side of the article of footwear, an arrangement on the lateral side is also possible and in particular useful for further reinforcement of the lateral side in the above mentioned sports like tennis, basketball, etc.

As material for the stability element and the integrated forefoot plate, preferably a composite material of carbon fibers embedded into a matrix of resin is used. Other suitable materials include glass fibers or para-aramid fibers, such as the Kevlar® brand sold by DuPont. These materials combine good elasticity values with low weight. Also, steel or other elastic metal alloys could be used in particular for the forefoot plate. Suitable plastic materials include thermoplastic polyether block amides, such as the Pebax® brand sold by Elf Atochem, and thermoplastic polyester elastomers, such as the Hytrel® brand sold by DuPont. Plastic materials have advantages with respect to production by injection molding, however, the necessary elastic properties can only be obtained through additional reinforcement with fibers. Other suitable materials will be apparent to those of skill in the art.

Having described embodiments of the invention, it will be apparent to those of ordinary skill in the art that other embodiments incorporating the concepts disclosed herein may be used without departing from the spirit and the scope of the invention. The described embodiments are to be considered in all respects only as illustrative and not restrictive. Therefore, it is intended that the scope of the present invention be only limited by the following claims.

What is claimed is:

1. An article of footwear having a longitudinal axis, comprising:

a rearfoot portion;

a forefoot portion; and a sole including a stability element extending from the rearfoot portion into the forefoot portion, the stability element comprising a forefoot portion, a rearfoot portion, a twisting area portion disposed therebetween, wherein the twisting area portion comprises at least one of a narrower lateral dimension, a thinner dimension, a more elastic material, a different shape, and any combination thereof than at least one of the forefoot portion and the rearfoot portion of the stability element to control in a pre-selected manner rotation of the forefoot portion relative to the rearfoot portion of the sole, and at least one elongate support element oriented essentially transversely relative to the longitudinal axis and extending from one of the stability element forefoot, rearfoot, and twisting area portions.

2. The article of footwear of claim 1, wherein the stability element supports a first metatarsal area, a second metatarsal area, or both of the footwear.

3. The article of footwear of claim 2, wherein the stability element supports a first phalange area, a second phalange area, or both of the footwear.

4. The article of footwear of claim 1, wherein the sole includes a medial side and a lateral side, and the stability element extends substantially along the lateral side of the forefoot portion.

5. The article of footwear of claim 1, wherein the stability element supports a fifth metatarsal area, a fourth metatarsal area, or both of the footwear.

6. The article of footwear of claim 5, wherein the stability element supports a fifth phalange area, a fourth phalange area, or both of the footwear.

7. The article of footwear of claim 1, wherein the stability element includes a forefoot area, and the forefoot area has a bending strength in the longitudinal direction of approximately 350 $N/mm^2$ to 600 $N/mm^2$, and a bending strength in the lateral direction of approximately 50 $N/mm^2$ and 200 $N/mm^2$.

8. The article of footwear of claim 7, wherein the forefoot area of the stability element has a bending strength in the longitudinal direction of approximately 450 $N/mm^2$ to 500 $N/mm^2$ and a bending strength in the lateral direction of approximately 90 $N/mm^2$ to 160 $N/mm^2$.

9. The article of footwear of claim 1, wherein the stability element includes a forefoot area, and the forefoot area of the stability element is constructed of a material that includes elastic properties for storing energy during the landing of the foot and releasing the energy during push-off of the foot from the ground without any substantial loss of energy.

10. The article of footwear of claim 1, wherein the stability element includes a forefoot area, and the forefoot area has a stiffness in the range of approximately 50 N/mm to 100 N/mm.

11. The article of footwear of claim 1, wherein the stability element is substantially planar in the fore foot portion.

12. The article of footwear of claim 1, wherein the sole includes a medial side and a lateral side, and the stability element extends substantially along both the medial side and the lateral side of the forefoot portion.

13. The article of footwear of claim 1, wherein the stability element includes at least one side element that extends upwardly from the stability element over an edge of the article of footwear.

14. The article of footwear of claim 1, wherein the stability element comprises a composite material reinforced by carbon fibers.

* * * * *